United States Patent [19]

Pusa

[11] 4,163,663

[45] Aug. 7, 1979

[54] REFINING PROCESS BASED ON TOP-BLOWING WITH OXYGEN

[75] Inventor: Onni Pusa, Oxelösund, Sweden

[73] Assignee: Svenskt Stål Aktiebolag, Stockholm, Sweden

[21] Appl. No.: 849,005

[22] Filed: Nov. 7, 1977

[30] Foreign Application Priority Data

Nov. 8, 1976 [DE] Fed. Rep. of Germany ..... 2650978

[51] Int. Cl.[2] ..... C21C 5/32; C21C 5/30

[52] U.S. Cl. ..... 75/60; 75/52

[58] Field of Search ..... 75/52, 60

[56] References Cited

U.S. PATENT DOCUMENTS

| | | | |
|---|---|---|---|
| 3,850,617 | 11/1974 | Umowski | 75/60 |
| 3,930,843 | 1/1976 | Fruehan | 75/60 |
| 4,001,012 | 1/1977 | Rote | 75/60 |

*Primary Examiner*—P. D. Rosenberg

*Attorney, Agent, or Firm*—Craig and Antonelli

[57] ABSTRACT

A process for refining iron melts by blowing oxygen onto the surface of the iron melt, the quantity or concentration of the stream of oxygen being kept constant for most of the blowing time and being reduced in one or more stages towards the end of the blowing time without any significant increase in the total blowing time.

13 Claims, No Drawings

REFINING PROCESS BASED ON TOP-BLOWING WITH OXYGEN

This invention relates to a refining process based on the top-blowing of oxygen.

Most conventional processes for refining pig iron into steel are based on the top-blowing of oxygen, as is the case for example with the LD-process, the Kaldo process and the LDAC-process. In the top-blowing of oxygen, it is known that a certain quantity of oxygen per unit of time is blown onto the surface of the molten pig iron, blowing being continued under constant conditions until the carbon content has fallen to the required level.

Unfortunately, these processes are attended by a whole number of disadvantages which are particularly noticeable where losses have to be made up. Apart from the fact that blowing with a constant quantity or rather concentration of oxygen or under a constant pressure per unit of time gives rise to high temperatures at which the lining can be affected, which can lead to repeated renewal of the furnace setting, metallic elements are increasingly oxidised during the constant blowing process and have to be replaced after refining. The metallic elements in question are primarily manganese which is generally blown down to very low levels, with the result that large quantities of ferromanganese or manganese metal have to be added.

The object of the present invention is to provide a process which reduces or completely avoids these disadvantages of the oxygen top-blowing technique. In principle, the process according to the invention consists, and is also characterised, in that the constancy of the blowing technique is abandoned. This variation comprises blowing a predetermined quantity of oxygen per unit of time onto the surface for a certain period, reducing the concentration or the pressure or the quantity to a lower level at a certain moment and thus completing the blowing process. This reduction in the quantity or flow of oxygen may of course also be effected in stages.

Where the invention is used in the Kaldo process, the reduction in the flow of oxygen is also accompanied with advantage by a change in the rotational speed of the converter.

In the example referred to above, the application of the process according to the invention resulted in the complete saving of the previous loss of manganese. It also resulted in less wear of the furnace lining, in a tangible gain by virtue of the smaller quantity of oxygen and also in the fact that certain work, for example paving, was no longer necessary.

In a variant of the process according to the invention, which is a logical extension of the basic concept of reducing the flow of oxygen, the reduction in the flow of oxygen is obtained by increasingly adding other gases, for example argon, to the oxygen so that the same effect as described above is automatically obtained.

The process according to the invention is by no means confined to the example given above, instead it may be used anywhere where refining is carried out by the top-blowing of oxygen.

The process according to the invention is simple and does not require any special equipment beyond the apparatus normally used. Attempts were made to follow the course of decarburization mathematically and to control refining through measurements and computer programs. It is characteristic of the value of these inventions and publications that they have never been nor could be adopted for use in practice because, on the one hand, they would add significantly to the cost of producing cheap iron and because, on the other hand, they necessitate a whole number of preliminary investigations and investigations during the actual refining process which are extremely time-consuming. Accordingly, it is only the technique of the top-blowing of oxygen which hitherto has been adopted in practice. Proof of this is the fact that, hitherto, it was not known how the loss of manganese for example could be reduced or prevented. Hitherto, this loss has been tacitly accepted.

In a steelworks with an annual output from the Kaldo process of around 730,000 tonnes, the loss of manganese in the conventional refining process amounted to around 0.4%, the manganese content of the starting material being of the order of 0.6% Mn at the beginning of the refining process and having fallen to 0.2% by the end of the refining process. By applying the process according to the invention, the loss of manganese could be reduced by 0.1% which corresponds to an annual saving of around 1,000,000 German Marks.

The process according to the invention is of considerable industrial value and represents a significant technical advance. In addition, the process according to the invention has a high degree of invention.

EXAMPLE

A number of batches were melted in a 150-tonne Kaldo converter, 120 tonnes of pig iron and 30 tonnes of steel scap being used in each batch. From the beginning of melting onwards, oxygen was blown on at a rate of 200 $Nm^3$/minute (normal cubic meters per minute). At the moment when the intensity of the refining process abated, as reflected in the decrease in the temperature of the waste gas, the rotational speed of the converter was reduced, as was also the quantity of oxygen blown on per minute, namely to 150 $Nm^3$/minute. Thereafter, the oxygen was blown on at this rate up to the moment at which the slag began to sputter. The supply of oxygen was cut off and the slag removed. Thereafter, the rotational speed was increased again and after the melt had cooled to around 1640° C., as measured with a pyrometer for example, blowing was continued with a further reduced flow of oxygen, namely 70 $Nm^3$/minute, up to completion. The total blowing time for each batch was 60 minutes, for approximately the first 55 minutes of which blowing was carried out normally with 200 $Nm^3$/minute of oxygen, the two reductions in the flow of oxygen being effected during the last 5 minutes of the total blowing time, firstly to 150 $Nm^3$/minute of oxygen for about 3 minutes and then to 70 $Nm^3$/minute of oxygen for about 2 minutes.

In the batches, the average composition of the starting material was as follows:

| | C | Mn |
|---|---|---|
| 120 t of pig iron | approx. 4.0% | approx. 0.55% |
| 30 t of steel scrap | approx. 0.10% | approx. 1.0% |

with the usual accompanying elements.

Some of the batches were blown with a constant stream of oxygen in the usual way up to the end of the refining process. The end product obtained contained on average approximately 0.10% of C and approximately 0.2% of Mn.

The rest of the batches were blown in accordance with the invention, i.e. the flow of oxygen was kept constant for most of the blowing time, being reduced in one or more stages towards the end of the blowing time. On completion of the refining process carried out in this way, the C-content amounted on average to approximately 0.10% and the Mn-content on average to 0.3%, i.e. was approximately 0.1% higher than in the conventional process. In the case of the process according to the invention, it was surprisingly found that, on completion of the blowing process, the carbon content was the same as that obtained in the conventional blowing process using a constant flow of oxygen although there was no change in the total blowing time, whereas the Mn-content left on completion of the blowing process was considerably higher.

The adjustment of the Mn-content to 1% after the blowing process produced a saving of 0.1% of Mn of the usual addition. The required analysis of the final steel was as follows:

approx. 0.10% C, approx. 1.0% Mn.

The moment at which the intensity of the refining process abates may also be determined otherwise, for example by measuring the changes in the composition of the waste gases.

All the particulars and features disclosed in the documents, where they are new either individually or in combination in relation to the prior art, are claimed as essential to the invention.

what is claimed is:

1. A process for refining iron melts comprising blowing a stream of oxygen onto the upper surface of an iron melt for a predetermined blowing time, the quantity of the oxygen fed per unit of time being kept constant until the intensity of refinement begins to abate, reducing the flow of oxygen in a first stage by about 10 to 50%, continuing blowing oxygen at said reduced flow of oxygen until slag on the surface of the melt begins to sputter, removing the slag, further reducing the flow of oxygen in a second stage by about 20 to 80%, and completing the blowing process with said last-mentioned further reduced flow of oxygen.

2. A process as claimed in claim 1, wherein the flow of oxygen is reduced in said first stage by about 20 to 30%.

3. A process as claimed in claim 1, wherein the flow of oxygen is reduced in said first stage by about 25%.

4. A process as claimed in claim 1, wherein the flow of oxygen is further reduced in said second stage by about 40 to 70%.

5. A process as claimed in claim 1, wherein the flow of oxygen is further reduced in said second stage by about 50 to 60%.

6. A process as claimed in claim 1, wherein the process is carried out in a Kaldo converter and the rotational speed of the converter is reduced at about the same time as at least one reduction in the flow of oxygen.

7. A process as claimed in claim 6, wherein the rotational speed of the converter is reduced at about the same time as the first reduction in the flow of oxygen to a value of from about 60% to about 40% of the normal rotational speed of the converter, and then increased again, at about the same time as the change in the flow of oxygen to complete blowing, to about the normal rotational speed of the converter.

8. A process as claimed in claim 6, wherein the rotational speed of the converter is reduced at about the same time as the first reduction in the flow of oxygen to a value of about 50% of the normal rotational speed of the converter, and then increased again, at about the same time as the change in the flow of oxygen to complete blowing, to about the normal rotational speed of the converter.

9. A process as claimed in claim 1, wherein after the slag has been removed, the melt is left to cool to about 1640° C. before being blown with the further reduced flow of oxygen.

10. A process as claimed in claim 1, wherein the combined blowing time during which the melt is blown with a reduced flow of oxygen constitutes between about 7 and 10% of the total blowing time.

11. A process as claimed in claim 1, wherein the combined blowing time during which the melt is blown with a reduced flow of oxygen constitutes about 8% of the total blowing time.

12. A process as claimed in claim 9, wherein the residual blowing time, during which the melt is blown after the slag has been removed, constitutes between about 2 and 5% of the total blowing time.

13. A process as claimed in claim 1, wherein the residual blowing time, during which the melt is blown after the slag has been removed, constitutes about 3.3% of the total blowing time.

* * * * *